US006615605B2

(12) United States Patent
Hattori

(10) Patent No.: US 6,615,605 B2
(45) Date of Patent: Sep. 9, 2003

(54) METHOD AND APPARATUS FOR ADJUSTING DEVICE USED AT LOW TEMPERATURE WITHOUT DETERIORATION THEREOF

(75) Inventor: Wataru Hattori, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/265,746

(22) Filed: Oct. 8, 2002

(65) Prior Publication Data

US 2003/0140648 A1 Jul. 31, 2003

Related U.S. Application Data

(62) Division of application No. 09/995,669, filed on Nov. 29, 2001, now Pat. No. 6,505,471.

(51) Int. Cl.[7] ..... F25D 17/02; F28D 5/00

(52) U.S. Cl. ..... 62/373; 62/304

(58) Field of Search ..... 62/51.1, 78, 373, 62/304; 374/176

(56) References Cited

U.S. PATENT DOCUMENTS

| | | | |
|---|---|---|---|
| 4,304,293 | A | 12/1981 | Scheiwe et al. |
| 4,739,622 | A | 4/1988 | Smith |
| 5,052,183 | A | 10/1991 | Koscica et al. |
| 5,086,620 | A | 2/1992 | Spears |
| 5,193,909 | A | 3/1993 | Duncan |

FOREIGN PATENT DOCUMENTS

| | | |
|---|---|---|
| JP | 62-190844 | 8/1987 |
| JP | 01-163570 | 6/1989 |
| JP | 04-099972 | 3/1992 |
| JP | 04-96849 | 8/1992 |
| JP | 2930109 | 5/1999 |

*Primary Examiner*—Ronald Capossela
(74) *Attorney, Agent, or Firm*—Whitham, Curtis & Christofferson, P.C.

(57) ABSTRACT

A method and apparatus for adjusting a device is provided in which characteristics of the device used at low temperature such as a high temperature superconductive filter are measured and adjusted without deterioration of the device. The device used at low temperature is disposed within an atmosphere of substitutional gas such as nitrogen and the like. The device is cooled by using cryogen, for example, liquid nitrogen, stored in a bath which is disposed in a glove box. The cryogen has a temperature near the temperature at which the device is used. The device is placed on a cooling stage which is partially soaked in the cryogen, thereby said device is cooled by the cryogen having a temperature near the temperature at which the device is used. Characteristics of the device are measured and adjusted while cooling the device by using the cryogen.

10 Claims, 2 Drawing Sheets

METHOD AND APPARATUS FOR ADJUSTING DEVICE USED AT LOW TEMPERATURE WITHOUT DETERIORATION THEREOF

This application is a division of U.S. patent application Ser. No. 09/995,669 filed Nov. 29, 2001 now U.S. Pat. No. 6,505,471.

FIELD OF THE INVENTION

The present invention relates generally to a method and apparatus for adjusting characteristics of a device. More particularly, the present invention relates to a method and apparatus for adjusting characteristics of a device used at low temperature in which characteristics of the device can be adjusted at a temperature at which the device is actually used and without causing deterioration of the device.

BACKGROUND OF THE INVENTION

A process of extracting and adjusting various characteristics of a device used at low temperature is one of very important processes in the fabrication of the device. An example of such device is a high temperature superconductive filter.

In order to extract or measure and to adjust characteristics of the device used at low temperature, there is known a method in which the device is adjusted while cooling the device in vacuum condition by using a freezer. Also, there is known a method in which the device is adjusted while cooling the device directly or indirectly by using cryogen or freezing mixture such as liquid nitrogen, liquid helium and the like. See Japanese utility model laid-open publication No. 4-96849, Japanese patent laid-open publication No. 62-190844, Japanese patent laid-open publication No. 1-163570 and the like.

However, among the methods mentioned above, when the method is used in which a device is adjusted while cooling the device in vacuum condition by using a freezer, it is necessary to introduce a freezer which is expensive. Therefore, manufacturing cost of the device becomes high.

Also, when the freezer is used, the time required for cooling the device to a desired temperature becomes longer than the time required for cooling the device to the desired temperature by using the cryogen. Therefore, the time required for adjusting the device becomes long.

On the other hand, when the method is used in which the device is adjusted while cooling the device directly or indirectly by using cryogen or freezing mixture such as liquid nitrogen, liquid helium and the like, the device is conventionally adjusted while cooling the device by using the cryogen in an atmosphere of air, and it is possible to cool the device enough by the cryogen.

In this method, it is possible, by using inexpensive liquid nitrogen, to rapidly cool and adjust a device, for example, a device which uses high temperature superconductor. Therefore, it is possible to greatly shorten the time required for adjusting the device, and to shorten the time required for manufacturing the device.

However, in the above-mentioned method in which the device is cooled by the cryogen in the atmosphere of air, among gas components contained in the atmosphere of air, gas component or components which become liquid or solid at the temperature to which the device is cooled coagulate and attach to the device. Therefore, there is a possibility that the device is deteriorated.

For example, in the device which uses high temperature superconductor, moisture contained in air in a room temperature coagulates at low temperature, and, especially, the coagulated moisture is liquefied during the temperature fall and temperature rise. Therefore, the liquefied moisture reacts with and invades the superconductor, and thereby the device is deteriorated.

SUMMARY OF THE INVENTION

Therefore, it is an object of the present invention to provide a method and apparatus for adjusting a device used at low temperature in which the device is not deteriorated due to the adjustment work of the device.

It is another object of the present invention to provide a method and apparatus for adjusting a device used at low temperature in which gas component or components contained in the atmosphere do not coagulate and attach to the device and the device is not deteriorated thereby.

It is still another object of the present invention to provide a method and apparatus for adjusting a device used at low temperature in which adjustment of the device is performed in the environment that do not include gas component or components coagulating and attaching to the device while cooling the device with cryogen and thereby the device is not deteriorated.

It is still another object of the present invention to obviate the disadvantages of the conventional method and apparatus for adjusting a device used at low temperature.

According to an aspect of the present invention, there is provided a method for adjusting a device used at low temperature comprising: disposing the device used at low temperature within an atmosphere of substitutional gas; cooling the device used at low temperature by using cryogen having a temperature near the temperature at which the device is used; and measuring and adjusting characteristics of the device used at low temperature.

In this case, it is preferable that the temperature of the cryogen is controlled by changing a pressure of the atmosphere of substitutional gas and thereby the temperature of the device is controlled.

It is also preferable that the atmosphere of substitutional gas is an atmosphere confined within a sealable glove box, and the device used at low temperature is placed on a cooling stage disposed within the sealable glove box and partially soaked in the cryogen stored in a bath which is disposed within the sealable glove box, thereby the device used at low temperature is cooled via the cooling stage by the cryogen hang a temperature near the temperature at which the device is used.

It is further preferable that the temperature of the device is controlled by using a temperature control portion which is disposed between the cooling stage and the device used at low temperature and which controls a temperature difference between the cooling stage and the device. It is advantageous that the device cooled by the cryogen is heated to a room temperature by using a hot plate.

It is also advantageous that the substitutional gas comprises gas or gases selected from a group consisting of an inert gas, a gas produced by the evaporation of the cryogen and a gas which does not invade the device.

It is further advantageous that vacuum atmosphere is used in place of the atmosphere of substitutional gas.

It is preferable that a material of the device used at low temperature includes a superconductive material It is also preferable that the superconductive material is a high temperature superconductive material It is further preferable that the device used at low temperature is a device including a band-pass filter having electrodes made of a high temperature superconductive material.

According to another aspect of the present invention, there is provided an apparatus for adjusting a device used at low temperature comprising: a sealable glove box within which the device used at low temperature can be disposed and which can be filled with substitutional gas; and a bath disposed within the sealable glove box and storing cryogen, the cryogen being used for cooling the device used at low temperature and having a temperature near the temperature at which the device is used; wherein characteristics of the device used at low temperature are measured and adjusted while cooling the device by using the cryogen and in the atmosphere of substitutional gas.

In this case, it is preferable that the temperature of the cryogen is controlled by changing a pressure of the atmosphere of substitutional gas and thereby the temperature of the device is controlled.

It is also preferable that the apparatus for adjusting a device used at low temperature further comprises a cooling stage which is partially soaked in the cryogen stored in the bath, wherein the device used at low temperature is placed on the cooling stage, thereby the device used at low temperature is cooled by the cryogen having a temperature near the temperature at which the device is used.

It is further preferable that the apparatus for adjusting a device used at low temperature further comprises a temperature control portion disposed between the cooling stage and the device used at low temperature and the temperature of the device is controlled by controlling a temperature difference between tile cooling stage and the device used at low temperature thereby.

It is advantageous that the apparatus for adjusting a device used at low temperature further comprises a hot plate which is disposed in the sealable glove box and by which the device cooled by the cryogen is heated to a room temperature.

It is also advantageous that the substitutional gas comprises gas or gases selected from a group consisting of an inert gas, a gas produced by the evaporation of the cryogen and a gas which does not invade the device.

It is further advantageous that, in place of the substitutional gas, the device is measured and adjusted in vacuum atmosphere.

It is preferable that materials constituting the device used at low temperature include a superconductive material.

It is also preferable that the superconductive material is a high temperature superconductive material.

It is further preferable that the device used at low temperature is a device including a band-pass filter.

BRIEF DESCRIPTION OF THE DRAWINGS

These and other features, and advantages, of the present invention will be more clearly understood from the following detailed description taken in conjunction with the accompanying drawings, in which like reference numerals designate identical or corresponding parts throughout the figures, and in which.

It will be appreciated that for simplicity and clarity of illustration, elements illustrated in the figures have not necessarily been drawn to scale. For example, the dimensions of some of the elements are exaggerated relative to other elements for clarity.

DESCRIPTION OF A PREFERRED EMBODIMENT

With reference to the drawings, embodiments of the present invention will now be described in detail.

In the present invention, when a device used at low temperature is to be adjusted, such device is disposed within the atmosphere of substitutional gas and is cooled by using cryogen having a temperature near the temperature at which the device is used or is to be used. Alternatively, when a device used at low temperature is to be adjusted, such device is disposed within vacuum atmosphere and is cooled by using cryogen having a temperature near the temperature at which the device is used or is to be used. In these conditions, characteristics of the device are extracted or measured, and adjusted.

Therefore, according to the present invention, the device cooled by the cryogen is not exposed to air. Therefore, among gas components contained in air, gas component or components which become liquid or solid at the cooled temperature of the device do not coagulate onto the device. Thus, it becomes possible to avoid deterioration of the device.

A more detailed explanation will now be made on an apparatus and method for adjusting a device used at low temperature according to the present invention.

Figure 1:
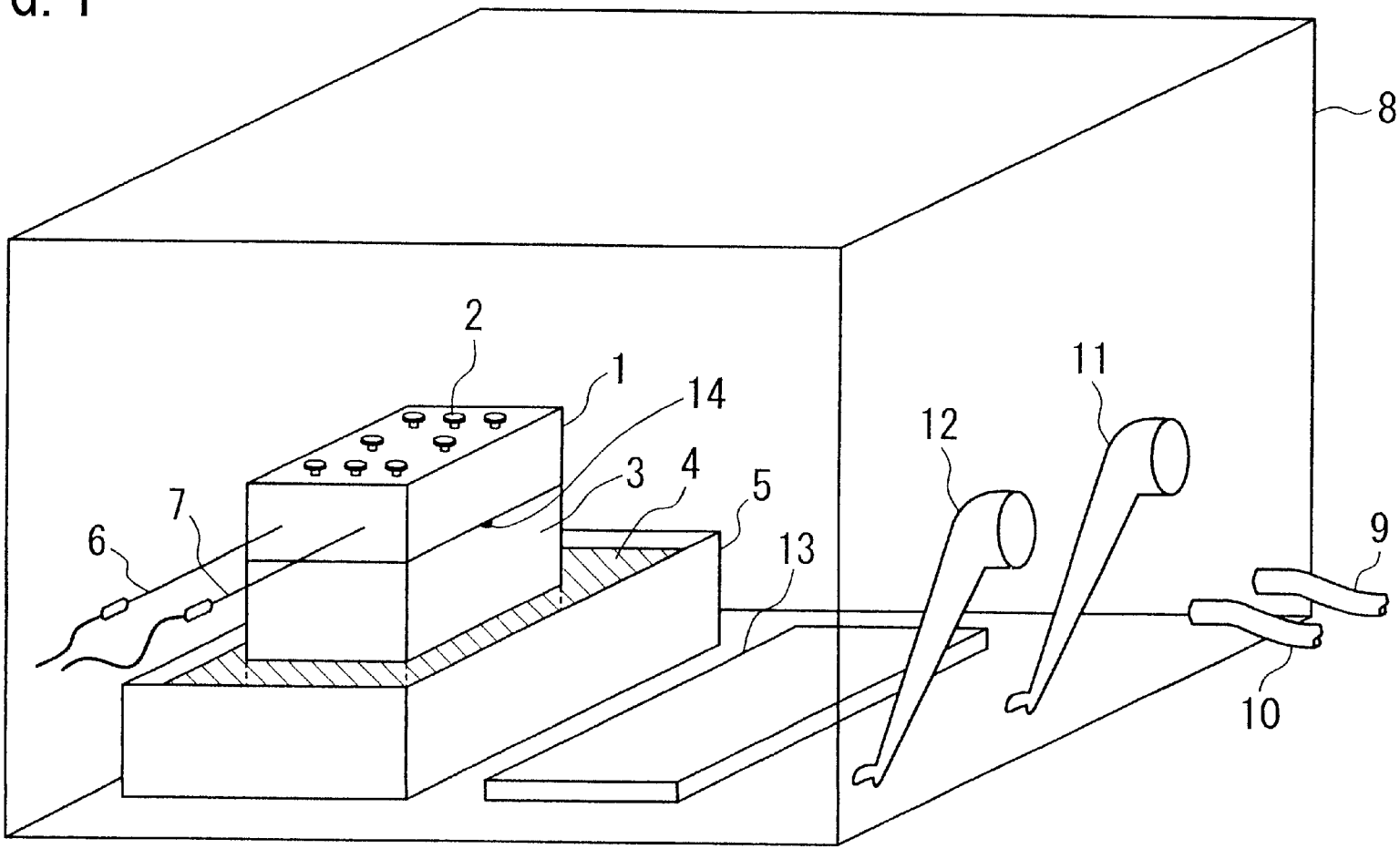
FIG. 1, is a schematic illustration of an apparatus for adjusting a device used at low temperature according to an embodiment of the present invention, in which a four stage band-pass filter using resonators constituted of high temperature superconductor is being adjusted.

FIG. 1 schematically illustrates an apparatus for adjusting a device used at low temperature according to an embodiment of the present invention, As an example, FIG. 1 shows a condition in which a four stage band-pass filter using resonators constituted of high temperature superconductor is used as the device used at low temperature and in which various characteristics of such four stage band-pass filter are measured and adjusted.

In FIG. 1, a four stage band-pass filter 1 comprises four dielectric resonators which use superconductor electrodes. On the top surface of the four stage band-pass filter 1, there are attached total eight (8) adjusting screws 2. Among eight adjusting screws, four screws are used for adjusting resonating frequencies of the four dielectric resonators, and other four screws are used for adjusting coupling between the resonators. The four stage band-pass filter 1 is placed on a metal cooling stage 3 made of metal having good thermal conductivity or heat conductivity. That is, the bottom surface of the four stage band-pass filter 1 contacts the upper surface of the metal cooling stage 3. The metal cooling stage 3 has a groove on the top surface thereof, and a thermometer 14 is disposed in the groove. The thermometer 14 comprises, for example, a thermoelectric thermometer, and is used for monitoring the temperature of the metal cooling stage 3 and the four stage band-pass filter 1. The thermometer 14 may be disposed at any other portion and may be other type of thermometer, as long as the temperature of the four stage band-pass filter 1 can be measured appropriately.

The metal cooling stage 3 is disposed within a reservoir or bath 5 made of material having low thermal conductivity.

The lower portion of the metal cooling stage 3 is soaked in the liquid nitrogen 4 as cryogen stored in the bath 5. Heat exchange occurs between the metal cooling stage 3 and the liquid nitrogen 4, and thereby the metal cooling stage 3 is cooled approximately to the boiling point of the liquid nitrogen 4. Also, heat exchange occurs between the four stage band-pass filter 1 and the metal cooling stage 3 and thereby the four stage band-pass filter 1 is also cooled approximately to the boiling point of the liquid nitrogen 4.

The bath 5 is made of material having low thermal conductivity, for example, polystyrene foam. The liquid nitrogen 4 is contained in the bath 5, and the lower portion of the cooling stage 3 is soaked in the liquid nitrogen 4 in the bath 5.

In this embodiment, the above-mentioned components are all contained in a sealed glove box 8.

The foul stage band-pass filter 1 is electrically coupled with a measurement apparatus such as a network analyzer and the like not shown in the drawing disposed outside the glove box 8, via coaxial cables 6 and 7. Thereby, characteristics such as transmission characteristics and the like of the four stage band-pass filter 1 are measured by the measurement apparatus. Examples of the characteristics measured and adjusted here are frequency characteristics of the band-pass filter, the center frequency or the band width of the pass band of the band-pass filter, flatness of the insertion loss of the band-pass filter, and the like.

Also, pipes 9 and 10 are connected to the glove box 8, in order to control gas composition, pressure and the like within the glove box 8. The pipe 9 is used, for example, as a supply pipe for supplying gas or gases, such as nitrogen gas and the like, from outside of the glove box 8. The pipe 10 is used, for example, as an exhaust pipe for exhausting air, moisture and the like from inside of the glove box 8.

Further, by using gloves 11 and 12, it is possible to freely handle equipments within the glove box 8 by hands.

In the glove box 8, there is disposed a hot plate 13 for heating the cooled four stage band-pass filter 1 to a room temperature.

Now, an explanation will be made on a method of adjusting a device used at low temperature according to an embodiment of the present invention. In this embodiment, characteristics of the above-mentioned four stage band-pass filter, as the device used at low temperature, are measured and adjusted.

First, the glove box 8 is opened by using, for example, the upper lid thereof not shown in the drawing, and the band-pass filter 1 to be measured and adjusted is placed on the hot plate 13 within the glove box 8. The temperature of the hot plate 13 is previously controlled to be a room temperature. Also, the bath 5 is filled with liquid nitrogen 4.

In this case, it is preferable that the liquid nitrogen 4 filling the bath 5, and nitrogen gas as a replacement gas supplied into the glove box 8 are those of the kind which does not invade the high temperature superconductor used in the band-pass filter 1.

In the condition the band-pass filter 1 is placed on the hot plate 13 and the bath 5 is filled with liquid nitrogen 4, the lid of the glove box 8 is closed and the glove box 8 is sealed.

Thereafter, dry nitrogen gas which does not contain moisture is pumped into the glove box 8 via the pipe 9, and, at the same time, air within the glove box 8 which contains moisture is exhausted from the glove box 8 via the pipe 10.

As a result, nitrogen gas evaporating from the liquid nitrogen 4 in the bath 5 and nitrogen gas supplied from the pipe 9 fill the glove box 8, and moisture which may invade the high temperature superconductor of the band-pass filter 1 is removed from the glove box 8.

Thereafter, by using the gloves 11 and 12, the band-pass filter 1 is moved from the top of the hot plate 13 to the top of the cooling stage 3. That is, the band-pass filter 1 on the hot plate 13 is manually moved onto the cooling stage 3. Of course, it is possible to move the band-pass filter 1 automatically by using any mechanics and the like. Thereby, the band-pass filter 1 is cooled by the cooling stage 3 at a temperature near the temperature at which the band-pass filter 1 is actually used.

When the band-pass filter 1 is cooled by the cooling stage 3, since moisture is already removed from the atmosphere within the glove box 8, moisture does not coagulate on the high temperature superconductor of the band-pass filter 1.

Then, the pressure of nitrogen gas within the glove box 8 is controlled by exhausting nitrogen gas from the glove box 8 via the pipe 10 and at the same time by controlling the quantity of nitrogen gas supplied from outside via the pipe 9. The temperature of the liquid nitrogen 4 is determined by the boiling point of the liquid nitrogen 4, and the boiling point of the liquid nitrogen 4 varies depending on the pressure of the nitrogen gas within the glove box 8. Thereby, the temperature of the liquid nitrogen 4 can be adjusted to a desired temperature.

By adjusting the temperature of the liquid nitrogen 4, the temperature of the cooling stage 3 and the band-pass filter 1 is also controlled accordingly, while monitoring the temperature by using the thermometer 14. After the temperature of the band-pass filter 1 becomes a predetermined temperature in which the band-pass filter 1 is to be adjusted, characteristics of the band-pass filter 1, such as transmission characteristics and the like, are measured by a network analyzer with which the band-pass filter is coupled via the coaxial cables 6 and 7. While measuring or monitoring the transmission characteristics and the like of the band-pass filter 1 by the network analyzer not shown in the drawing, the characteristics of the band-pass filter 1 are adjusted by turning each of the adjusting screws 2.

After finishing the adjustment of the band-pass filter 1, the band-pass filter 1 is removed from the top of the cooling stage 3 and placed again on the hot plate 13 within the glove box 8. Thereby, the temperature of the band-pass filter 1 is returned to a room temperature. Thereafter, the lid of the glove box 8 is opened, and the band-pass filter 1 is taken out of the glove box 8.

Therefore, according to the present embodiment, there are provided a method and an apparatus for adjusting a device used at low temperature in which measurement and/or adjustment of characteristics of the device is performed by cooling the device with cryogen having a temperature near the temperature at which the device is used. In the method and apparatus according to the present embodiment, the measurement and/or adjustment is performed in the atmosphere from which gas component or components, such as moisture contained in the air, that become liquid at the cooled temperature and that coagulate on the device and invade the device are removed. Therefore, the device is not deteriorated by the adjustment work.

In the above-mentioned embodiment, nitrogen ($N_2$) gas is used as the substitutional gas. However, it is possible to use any other substitutional gas as long as it is inert gas. Examples of such inert gases are argon (Ar), neon (Ne), helium (He) and the like. Also, in the above-mentioned embodiment, liquid nitrogen is used as the cryogen.

However, the cryogen is not limited to liquid nitrogen, but can be any cryogen that can cool the device to a temperature near the temperature at which the device is actually used.

Further, in the above-mentioned embodiment, the device to be adjusted is the four stage band-pass filter. However, it is possible to use a device other than the band-pass filter. Also, in the above-mentioned embodiment, the device to be adjusted is composed of a material including superconductive material. However, it is possible to use a material other than the superconductive material. In the above-mentioned embodiment, the superconductive material is a high temperature superconductive material. However, it is possible to use the superconductive material other than the high temperature superconductive material.

Figure 2:
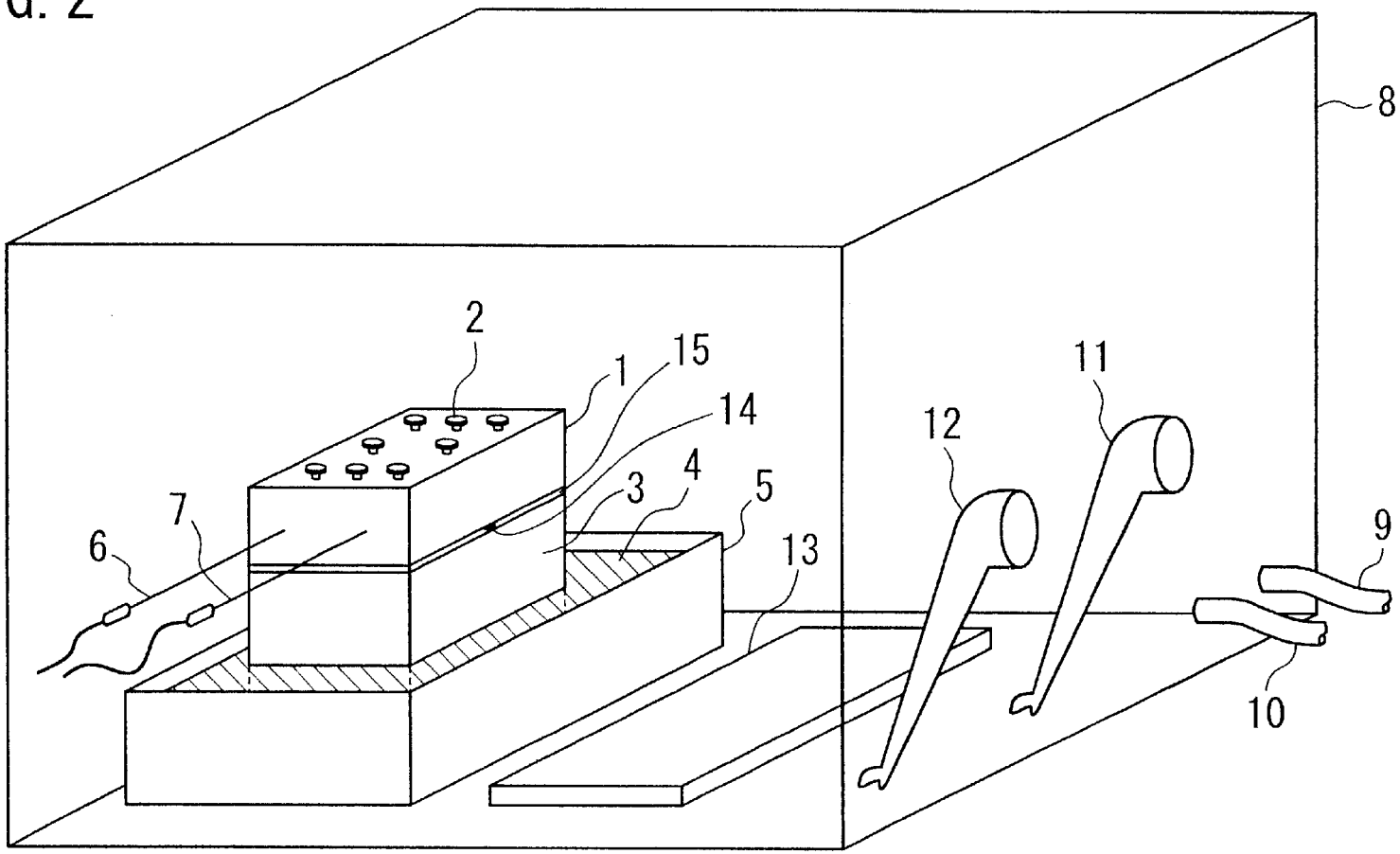
FIG. 2, is a schematic illustration of an apparatus for adjusting a device used at low temperature according to another embodiment of the present invention, in which a four stage band-pass filter using resonators constituted of high temperature superconductor is being adjusted.

FIG. 2 schematically illustrates an apparatus for adjusting a device used at low temperature according to another embodiment of the present invention. In this embodiment, there is provided a temperature control portion 15 on the top surface of the metal cooling stage 3, that is, between the metal cooling stage 3 and the four stage band-pass filter 1. The temperature control portion 15 may be a sheet heater, a Peltier element or the like, and controls a temperature difference between the metal cooling stage 3 and the four stage band-pass filter 1. Also, a thermometer 14 is disposed, for example, on the upper surface or in a groove of the temperature control portion 15. Other portions of the apparatus shown in FIG. 2 may be the same as those of the first embodiment described with reference to FIG. 1, and detailed explanation thereof is omitted here.

In the apparatus shown in FIG. 2, by applying an appropriate voltage or current to the temperature control portion 15 from a power source not shown in the drawing, the temperature of the top surface of the temperature control portion 15 contacting the bottom surface of the four stage band-pass filter 1 can be adjusted to a desired temperature. Therefore, when measuring and adjusting the device used at low temperature, the temperature of the device can be adjusted to a desired temperature, not by controlling the pressure of nitrogen gas within the glove box 8, but only by controlling the voltage or current supplied to the temperature control portion 15. Therefore, the temperature of the device used at low temperature can be adjusted to a desired value easily and precisely.

Also, in the embodiment explained above, the device used at low temperature is placed within the atmosphere of substitutional gas, and the device is cooled by using the cryogen having a temperature near the temperature at which the device is used. However, it is possible to change the above-mentioned atmosphere of substitutional gas in the glove box 8 into the vacuum atmosphere. That is, the device used at low temperature can be placed in the vacuum atmosphere and cooled by using cryogen having a temperature near the temperature at which the device is used, thereby various characteristics of the device can be measured and adjusted In this case, it is preferable that the bath 5 in which liquid nitrogen is stored is sealed by using, for example, and upper lid from the vacuum atmosphere in the glove box 8. The upper lid of the bath 5 should have an opening through which the upper portion of the cooling stage 3 can protrude into the glove box 8.

As mentioned above, according to the present invention, there are provided a method and an apparatus for adjusting a device used at low temperature in which measurement and/or adjustment of characteristics of the device is performed by cooling the device with cryogen having a temperature near the temperature at which the device is used. In the method and apparatus according to the present invention, the measurement and/or adjustment is performed in the atmosphere of replacement gas selected from a group consisting of inert gas, gas produced by the evaporation of cryogen, and any gas which does not invade the device to be adjusted, or in vacuum condition. Therefore, the cooled device is not exposed to the air, and gas component or components contained in the air, such as moisture, that become liquid or solid at the cooled temperature and that coagulate on the device and invade the device are completely removed. Therefore, the device is not deteriorated during the adjustment work.

That is, according to the present invention, a process of measuring and/or adjusting characteristics of the device used at low temperature is performed by cooling the device with cryogen having a temperature near the temperature at which the device is used. In this case, such process of measuring and/or adjusting the device can be performed in the atmosphere in which, among the gas components contained in the sir, gas component or components that become liquid or solid at the cooled temperature do not coagulate on the device and do not deteriorate the device.

In the foregoing specification, the invention has been described with reference to specific embodiments. However, one of ordinary skill in the art appreciates that various modifications and changes can be made without departing from the scope of the present invention as set forth in the claim below. Accordingly, the specification and figures are to be regarded in an illustrative sense rather than a restrictive sense, and all such modifications are to be included within the scope of the present invention. Therefore, it is intended that this invention encompasses all of the variations and modifications as fall within the scope of the appended claims.

What is claimed is:

1. An apparatus for adjusting a device used at low temperature comprising:

sealable glove box within which said device used at low temperature can be disposed and which can be filled with substitutional gas; and a bath disposed within said sealable glove box and storing cryogen, said cryogen being used for cooling said device used at low temperature and having a temperature near the temperature at which said device is used;

wherein characteristics of said device used at low temperature are measured and adjusted while cooling said device by using said cryogen and in the atmosphere of substitutional gas.

2. An apparatus for adjusting a device used at low temperature as set forth in claim 1, wherein the temperature of said cryogen is controlled by changing a pressure of said atmosphere of substitutional gas and thereby the temperature of said device is controlled.

3. An apparatus for adjusting a device used at low temperature as set forth in claim 1, further comprising a cooling stage which is partially soaked in said cryogen stored in said bath, wherein said device used at low temperature is placed on said cooling stage, thereby said device used at low temperature is cooled by said cryogen having a temperature near the temperature at which said device is used.

4. An apparatus for adjusting a device used at low temperature as set forth in claim 3, further comprising a temperature control portion disposed between said cooling stage and said device used at low temperature and the temperature of said device is controlled by controlling a temperature difference between said cooling stage and said device used at low temperature thereby.

5. An apparatus for adjusting a device used at low temperature as set forth in claim 1, further comprising a hot plate which is disposed in said sealable glove box and by which said device cooled by said cryogen is heated to a room temperature.

6. An apparatus for adjusting a device used at low temperature as set forth in claim 1, wherein said substitutional gas comprises gas or gases selected from a group consisting of an inert gas, a gas produced by the evaporation of said cryogen and a gas which does not invade said device.

7. An apparatus for adjusting a device used at low temperature as set forth in claim 1, wherein, in place of said substitutional gas, said device is measured and adjusted in vacuum atmosphere.

8. An apparatus for adjusting a device used at low temperature as set forth in claim 1, wherein materials constituting said device used at low temperature include a superconductive material.

9. An apparatus for adjusting a device used at low temperature as set forth in claim 8, wherein said superconductive material is a high temperature superconductive material.

10. An apparatus for adjusting a device used at low temperature as set forth in claim 1, wherein said device used at low temperature is a device including a band-pass filter.

* * * * *